US010411391B2

(12) United States Patent
Tang et al.

(10) Patent No.: US 10,411,391 B2
(45) Date of Patent: Sep. 10, 2019

(54) POWER STRIP WITH TWO ENDS SAFELY PLUGGABLE AND A POWER STRIP ASSEMBLY WITH PLUG

(71) Applicant: Shenzhen HUYUAN Electric Technology Co., Ltd., Shenzhen, Guangdong (CN)

(72) Inventors: Jinlong Tang, Guangdong (CN); Yanhui Li, Guangdong (CN)

(73) Assignee: Shenzhen HUYUAN Electric Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/034,376

(22) Filed: Jul. 13, 2018

(65) Prior Publication Data

US 2019/0020144 A1 Jan. 17, 2019

(30) Foreign Application Priority Data

Jul. 14, 2017 (CN) ..... 2017 1 0577033
Oct. 19, 2017 (CN) ..... 2017 1 0978754
Jul. 11, 2018 (CN) ..... 2018 1 0759659

(51) Int. Cl.

| | |
|---|---|
| ***H01R 13/453*** | (2006.01) |
| ***H01R 27/00*** | (2006.01) |
| ***H01R 13/639*** | (2006.01) |
| ***H01R 25/00*** | (2006.01) |
| ***H01R 13/627*** | (2006.01) |

(52) U.S. Cl.

CPC ..... *H01R 13/4538* (2013.01); *H01R 13/639* (2013.01); *H01R 25/003* (2013.01); *H01R 27/00* (2013.01); *H01R 13/6273* (2013.01)

(58) Field of Classification Search

CPC .. H01R 13/4538; H01R 13/639; H01R 27/00; H01R 31/06; H01R 33/94

See application file for complete search history.

(56) References Cited

U.S. PATENT DOCUMENTS 2,288,241 A * 6/1942 Holcomb ..... H01R 13/44 439/136
2,552,061 A * 5/1951 Popp ..... H01R 13/447 439/136
3,201,740 A * 8/1965 Rubens ..... H01R 13/447 174/67
3,222,631 A * 12/1965 Cohen ..... H01R 13/4534 174/67
3,407,376 A * 10/1968 Martin ..... H01R 13/4532 439/138
4,632,479 A * 12/1986 Jacobson ..... H01R 13/447 439/145
4,729,741 A * 3/1988 Peng ..... H01R 13/447 439/135
4,768,965 A * 9/1988 Chang ..... H01R 13/447 439/135

(Continued)

*Primary Examiner* — Briggitte R. Hammond

(57) ABSTRACT

The present invention discloses a power strip with two ends safely pluggable, used for connecting with a plug, the power strip is provided with two receiving spaces respectively arranged at two ends of the power strip for allowing the plug to plug in, the receiving space is provided with pins and a blocking structure, the blocking structure is configured for, when the plug is plugged into one of the receiving spaces, closing or obstructing the other receiving space.

18 Claims, 6 Drawing Sheets

(56) References Cited

U.S. PATENT DOCUMENTS

| | | | | | |
|---|---|---|---|---|---|
| 4,834,664 | A * | 5/1989 | Lin | H01R 13/447 | 439/145 |
| 5,866,846 | A * | 2/1999 | Huag | H01R 13/4532 | 439/143 |
| 6,086,391 | A * | 7/2000 | Chiu | H01R 13/4534 | 439/145 |
| 7,086,879 | B2 * | 8/2006 | Higham | H01R 31/06 | 439/137 |
| 8,408,924 | B1 * | 4/2013 | Queru | H01R 31/06 | 439/136 |
| 9,203,173 | B2 * | 12/2015 | Wang | H01R 13/447 | |
| 2009/0311892 | A1 * | 12/2009 | Weeks | H01R 13/4534 | 439/137 |
| 2010/0053851 | A1 * | 3/2010 | Bernstein | A61B 5/14532 | 439/136 |
| 2013/0075557 | A1 * | 3/2013 | Hsiao | H02G 3/185 | 248/223.41 |

* cited by examiner

POWER STRIP WITH TWO ENDS SAFELY PLUGGABLE AND A POWER STRIP ASSEMBLY WITH PLUG

CROSS REFERENCE TO RELATED APPLICATIONS

This application claims priority to Chinese Patent Application Nos. 201710577033.6 filed on Jul. 14, 2017, 201710978754.8 filed on Oct. 19, 2017 and 201810759659.3 filed on Jul. 11, 2018. The entire contents of the above applications are hereby incorporated by reference.

TECHNICAL FIELD

The present invention relates to the technical field of power strip, and particularly to a power strip with two ends safely pluggable and a power strip assembly with plug.

BACKGROUND

Power strips each are provided with a plurality of sockets that is capable of receiving a plurality of plugs, to electrically connect with other circuits and achieve electrical connection for a plurality of circuits simultaneously, which greatly facilitates the people's lives. With the development and progress of society, people began to pursue the simplicity and comfort in life. In order to meet the need of people's lives, various electrical products have been developed, the power strips have become a necessity of our life. There are two typical kinds of power strip assembly with plug, one is integrated connection type and the other is detachable connection type, both of which have its own shortcomings as follows. For the power strip assembly with plug of integrated connection type, the power strip and the extension cord must be soldered together manually after they have been manufactured separately. As a result, it is impossible to realize automatic production during the manufacturing of the power strip assembly, which reduces the efficiency of production. In addition, There is also a risk to raise the problem of joint invalidation. For the power strip assembly with plug of detachable connection type, the power strip is provided with only one receiving space at one end. When connecting the power strip and the plug, users often hold the end of the power strip without receiving space, and the user has to change to the other end of the power strip, which is inconvenient for users to assemble the power strip and the plug and use the power strip.

SUMMARY

A main object of the present invention is to provide a power strip with two ends safely pluggable and a power strip assembly with plug which have the advantages of automatic manufacture, high efficiency, convenient to use and high safety, to solve the problem of unable to automatic manufacture, inconvenient to use and unstable connection existing in prior power strip assembly with plug.

The object of the present invention can be achieved by following technical solutions. A power strip with two ends safely pluggable, used for connecting with a plug, the power strip is provided with two receiving spaces respectively arranged at two ends of the power strip for allowing the plug to plug in, the receiving space is provided with pins and a blocking structure, the blocking structure is configured for, when the plug is plugged into one of the receiving spaces, closing or obstructing the other receiving space.

Further, the blocking structure comprises a sliding part which is slidably mounted in the power strip, when the plug is plugged into one of the receiving spaces, one end of the sliding part away from the one of the receiving space protrudes into the other receiving space.

Further, the sliding part is a sliding rod which linearly slides along a length of the power strip.

Further, a block is slidably mounted in the receiving space, the block has first through holes to allow the pins to pass through, a first elastic part is provided between the block and a bottom wall of the receiving space and is used for exerting a force on the block away from the bottom wall of the receiving space when the first elastic part is pressed.

Further, the block is provided with a through groove for the sliding part passing through.

Further, both ends of the sliding part are respectively fixedly connected with the block.

Further, the receiving space is provided with a plurality of guiding rods which are slidably connected with the block, the first elastic part is mounted around the guiding rod.

Further, the power strip further includes a protective door structure which comprises a baffle plate and a second elastic part, two ends of the second elastic part are respectively connected with the baffle plate and the block, the baffle plate is provided with insert holes and is slidably connected with the block, thus enables the insert holes to be aligned or misaligned with the first through holes in the block.

Further, the baffle plate is provided with a wedge-shaped block.

The present invention also provides a power strip assembly with plug, comprising the above power strip with two ends safely pluggable and a plug pluggable with the power strip.

Further, the blocking structure comprises a sliding part which is slidably mounted in the power strip, when the plug is plugged into one of the receiving spaces, one end of the sliding part away from the one of the receiving space protrudes into the other receiving space.

Further, the sliding part is a sliding rod which linearly slides along a length of the power strip.

Further, a block is slidably mounted in the receiving space, the block has first through holes to allow the pins to pass through, a first elastic part is provided between the block and a bottom wall of the receiving space and is used for exerting a force on the block away from the bottom wall of the receiving space when the first elastic part is pressed.

Further, the block is provided with a through groove for the sliding part passing through.

Further, both ends of the sliding part are respectively fixedly connected with the block.

Further, the receiving space is provided with a plurality of guiding rods which are slidably connected with the block, the first elastic part is mounted around the guiding rod.

Further, the power strip further includes a protective door structure which comprises a baffle plate and a second elastic part, two ends of the second elastic part are respectively connected with the baffle plate and the block, the baffle plate is provided with insert holes and is slidably connected with the block, thus enables the insert holes to be aligned or misaligned with the first through holes in the block.

Further, a fastening structure is provided on the plug and the power strip for fixedly connecting the plug and the power strip when the plug is plugged into the power strip.

Further, the fastening structure comprises a buckling section arranged on the power strip and a joining section arranged on the plug, one of the buckling section and the joining section is elastic, when the plug is plugged into the power strip, the buckling section and the joining section are interlocked.

Further, the fastening structure further comprises a push plate slidably connected with the plug, the push plate is provided with an elastic piece two ends of which are respectively abut against the push plate and the power strip, and a tongue piece for separating the buckling section and the joining section.

Carrying out the present invention has following advantages. On the one hand, the plug and power strip are detachable connecting structure. In the process of manufacture, plug and power strip are detachable connectable. During manufacturing, the plug and power strip can be produced separately and automatically, with no need to solder them together. As the plug and power strip are sold to the users, users can complete electrical connecting between them by manually plugging the plug into the power strip, which eliminates the manually assembling process of connecting the plug and power strip in the process of production, and completely realizes automatic production of the power strip assembly with plug of the present invention, greatly improving the efficiency of production, and reducing the costs of production. On the other hand, in use, users thereby only need to hold either end of the power strip in one hand and the plug in the other, then plug the plug into the receiving space conveniently, and thus realize the connection of plug and power strip quickly, which is easy and convenient to use, and solves the problem of inconvenience to the assembling and use of the traditional power strip assembly with plug provided with only one receiving space, which make the users often have to change to the end of the power strip having the receiving space when the users hold the end without the receiving space. Either receiving space can be blocked by the blocking structure, when the plug is plugged into one of the receiving space, the plug and power strip are electrically connected, while the other receiving space is closed or obstructed and unavailable, thus, a risk of electric leakage and electric shock caused by plugging another plug into the other receiving space is avoided, which ensures the safety of use of the power strip.

BRIEF DESCRIPTION OF THE DRAWINGS

In the following, the drawings required by the embodiments or prior art will be described simply to make the technical solution of the present invention clearer. Obviously, the described drawings herein are merely those of some embodiments of the present invention. According to these drawings, other drawings can be obtained by the persons skilled in the art without creative work according to the drawings.

DESCRIPTION OF THE EMBODIMENTS

Figure 1:
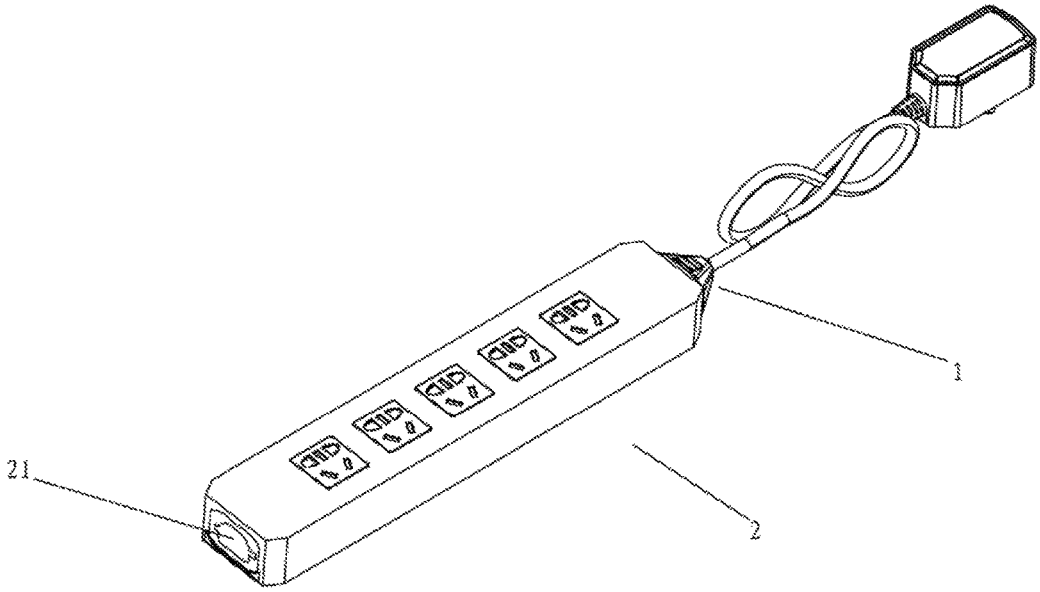
FIG. 1 is a schematic view of the power strip assembly with plug according to the present invention.
Figure 2:
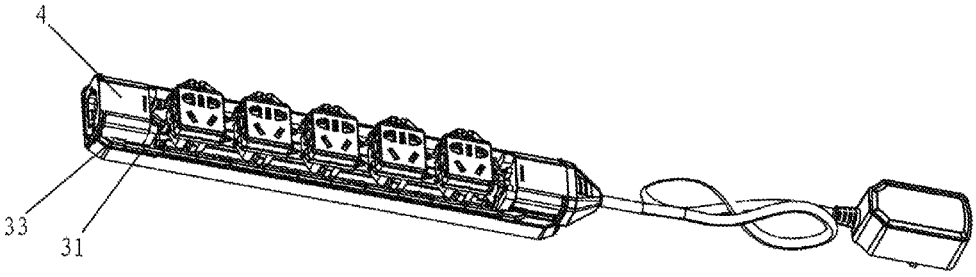
FIG. 2 illustrates an interior of the power strip assembly with plug shown in FIG. 1.
Figure 3:
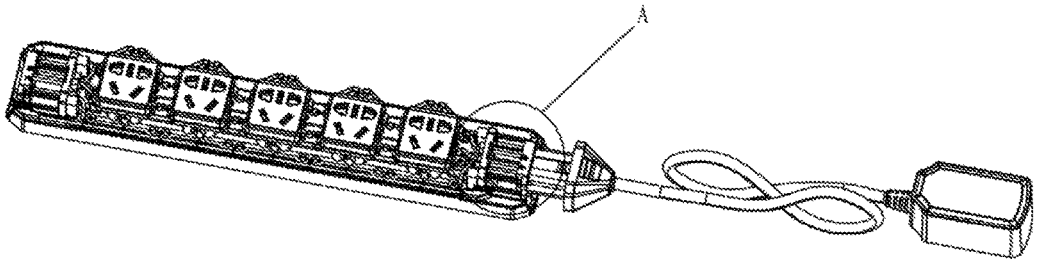
FIG. 3 shows the power strip assembly with plug shown in FIG. 2, in which mounting seats thereof are removed.
Figure 4:
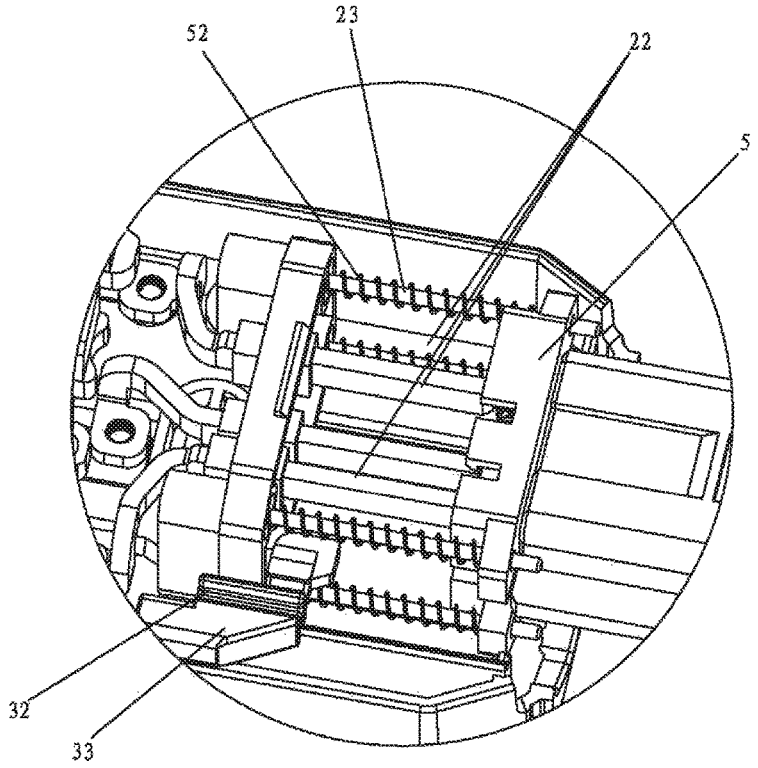
FIG. 4 is a partial enlarged view of portion A shown in FIG. 3.

In the following, the technical solution of embodiments of the present invention will be described clearly and completely with reference to the figures of embodiments of the invention. Obviously, the described embodiments are merely some embodiments of the invention, but not all. The other embodiments obtained by the persons skilled in the art without creative work also belongs to the scope of protection of the invention.

Referring to FIGS. 1 to 4, a power strip assembly with plug according to the present invention is shown, which comprises a plug 1 and a power strip 2, the power strip 2 is provided with a mounting seat 4 at each end. The mounting seat 4 is provided with a receiving space 21 therein for allowing the plug 1 to plug in. The receiving space 21 is provided with pins 22 therein, preferably, the pins 22 are standard three-pole pins. The plug 1 is provided with jacks corresponding to the pins 22. The receiving space 21 is provided with a blocking structure, when the plug 1 is plugged in one of the receiving space 21, the blocking structure makes the other receiving space 21 closed or obstructed.

The plug 1 and power strip 2 are detachable connectable. During manufacturing, the plug 1 and power strip 2 can be produced separately and automatically, with no need to solder them together. As the plug 1 and power strip 2 are sold to the users, users can complete electrical connecting between them by manually plugging the plug 1 into the power strip 2, which eliminates the manually assembling process of connecting the plug 1 and power strip 2 in the process of production, and completely realizes automatic production of the power strip assembly with plug of the present invention, greatly improving the efficiency of production, and reducing the costs of production.

As the power strip 2 is provided with two receiving spaces 21, one at each end, in use, users thereby only need to hold either end of the power strip 2 in one hand and the plug 1 in the other, then plug the plug 1 into the receiving space 21 conveniently, and thus realize the connection of plug 1 and power strip 2 quickly, which is easy and convenient to use, and solves the problem of inconvenience to the assembling and use of the traditional power strip assembly with plug provided with only one receiving space 21, which make the users often have to change to the end of the power strip 2 having the receiving space when the users hold the end without the receiving space. Either receiving space 21 can be blocked by the blocking structure, when the plug 1 is plugged into one of the receiving space 21, the plug 1 and power strip 2 are electrically connected, while the other receiving space 21 is closed or obstructed and unavailable, thus, a risk of electric leakage and electric shock caused by plugging another plug 1 into the other receiving space 21 is avoided, which ensures the safety of use of the power strip 2.

In this embodiment, the blocking structure is a sliding part 31 which is slidably mounted in the power strip 2, preferably, the sliding part 31 is a sliding rod in this embodiment. When the plug 1 is plugged into one of the receiving space 21, the plug 1 urges one end of the sliding rod simultaneously and pushes the other end of the sliding rod to protrude into the other receiving space 21, which can prevent another plug from plugging in due to the obstruction by the sliding rod, as a result, the risk of electric leakage and electric shock caused by misoperation of plugging another plug 1 into the other receiving space 21 can be avoided.

Preferably, the power strip 2 is provided with a guide rail therein, the sliding rod is provided with a groove 32 engaging with the guide rail. The groove 32 slidably receives the guide rail in such a way that the sliding rod is slidably mounted in the power strip 2. The guide rail constrains the sliding rod to slide only along the length of the guide rail, which enables each end of the sliding rod to protrude into or slide out from the corresponding receiving space 21 and realizes closure or obstruction of the receiving space 21.

To make the structure of the sliding rod simpler and the design of the groove 32 more convenient, a head 33 is fixedly mounted or formed on each end of the sliding rod, and the groove 32 is defined in the head 33. With the loose fit between the groove 32 of the head 33 and the guide rail of the power strip 2, a slidable engagement is achieved, such that the sliding rod can be designed much simpler and compacter, with no need to provide an overlong groove 32 on the sliding rod.

Figure 5:
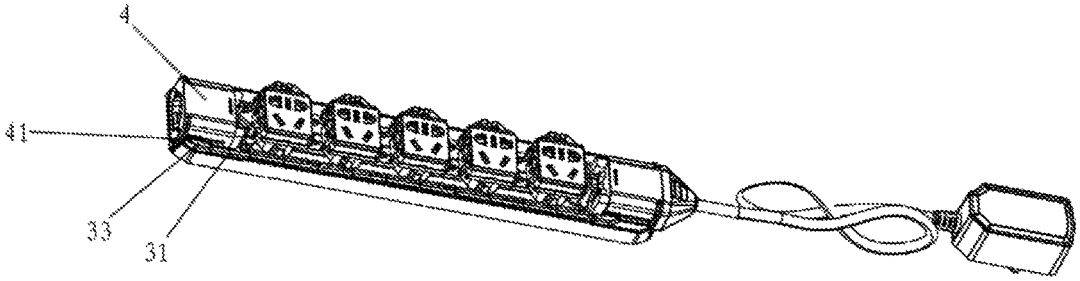
FIG. 5 illustrates an interior of the power strip assembly with plug, in which the mounting seat thereof is provided a guiding groove.
Figure 6:
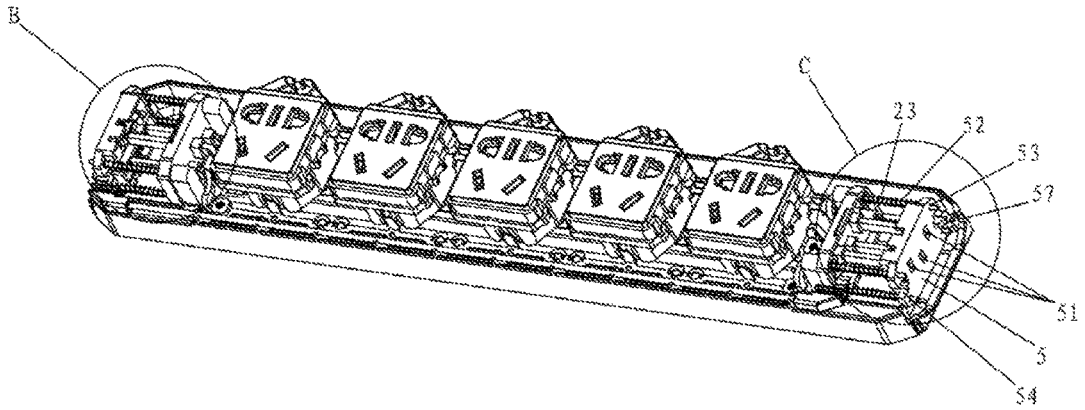
FIG. 6 shows an interior of a power strip according to the present invention, in which mounting seats thereof are removed.
Figure 7:
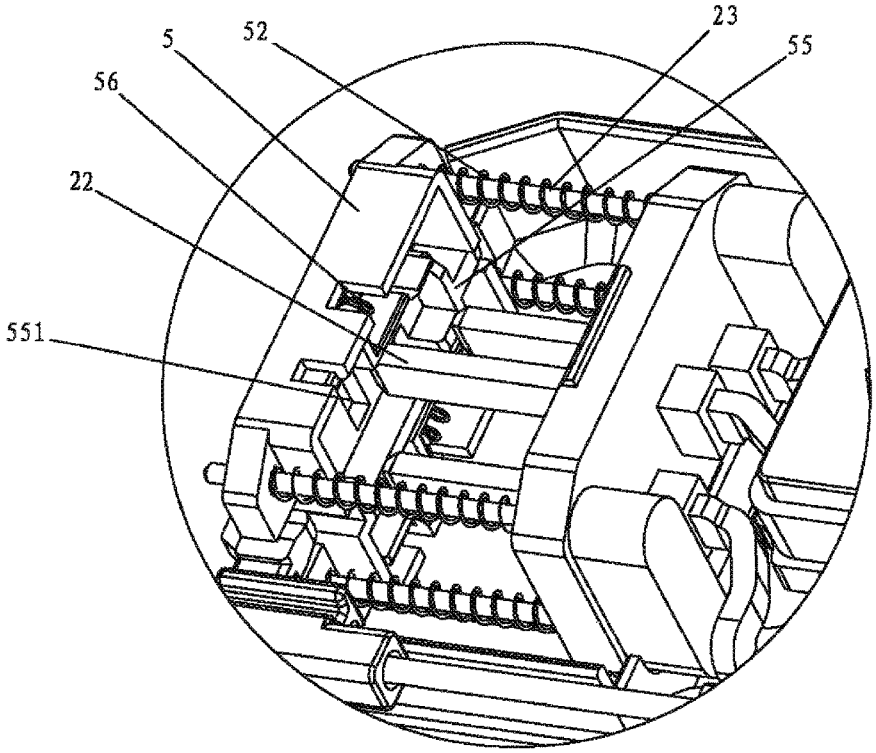
FIG. 7 is a partial enlarged view of portion B shown in FIG. 6.
Figure 8:
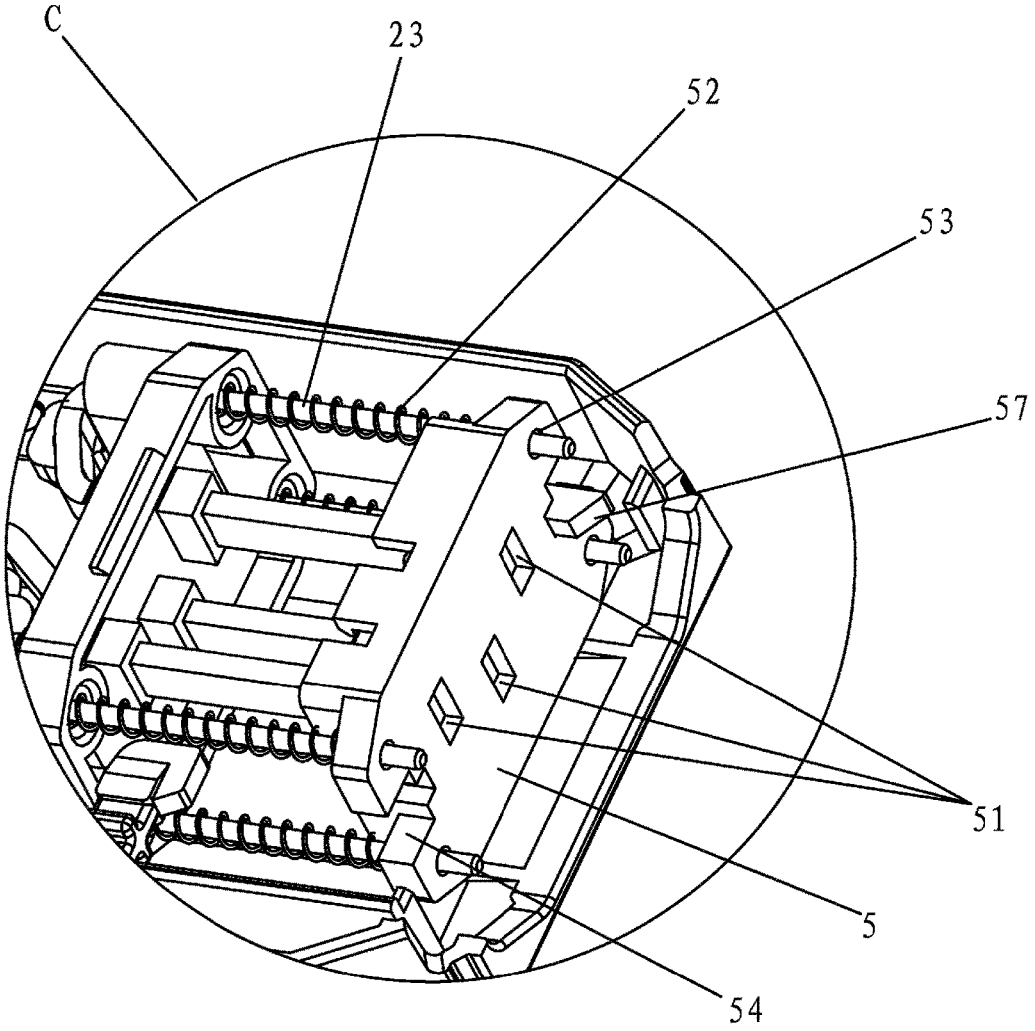
FIG. 8 is a partial enlarged view of portion C shown in FIG. 6.
Figure 9:
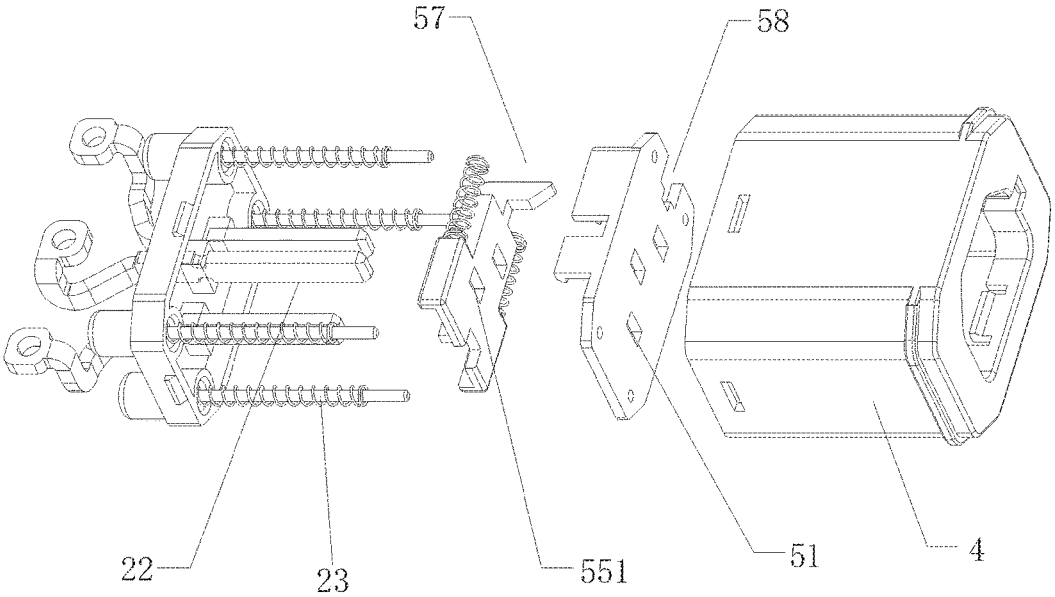
FIG. 9 is an exploded view of the mounting seat.
Figure 10:
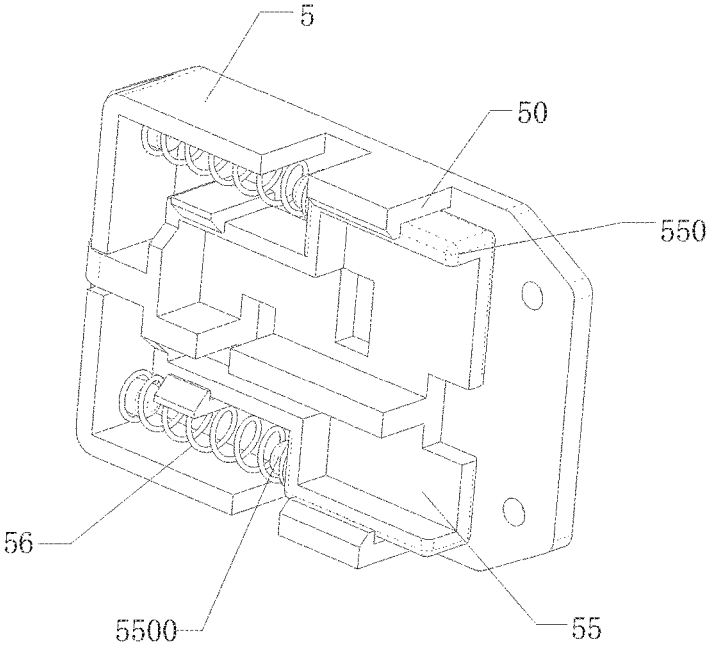
FIG. 10 illustrates the assembly of a baffle plate and a block of the power strip of FIG. 9.

Alternatively, as shown in FIG. 5, the mounting seat 4 is provided with a guiding groove 41 (in this case, there is no need to provide a groove 32 on the head 33), the head 33 of the sliding rod is slidably received in the guiding groove 41, the guiding groove 41 constrains the sliding rod to linearly slide only along the length of the guiding groove 41.

Preferably, as shown in FIGS. 6 to 10, a block 5 with a plurality of first through holes 51 to allow pins 22 to pass through is slidably mounted in the receiving space 21, that is, the pins 22 are positioned corresponding to the first through holes 51. A first elastic part 52 is provided between the block 5 and the bottom wall of the receiving space 21, in this embodiment, two ends of the first elastic part 52 respectively abut the block 5 and the bottom wall of the receiving space 21 to push the block 5 towards opening of the receiving space 21, which enables the pins 22 to disengage from the first through holes 51. When there is no plug plugged in the receiving space 21, the pins 22 are not inserted into the first through holes 51. When the plug is plugged in one of the receiving space 21, the plug 1 urges the block 5 in this receiving space to slide and accordingly the pins 22 passes through the first through holes 51, the plug 1 and the pins 22 are connected together, while the block 5 in the other receiving space 21 is pushed to the front end of the pins 22 under the force of the first elastic part 52. Therefore, human hands reaching into the other receiving space 21 would be blocked by the block 5 rather than directly touching the pins 22, which prevents accident of electric shock, further guarantees the personal safety of users.

Preferably, the receiving space 21 is provided with a plurality of guiding rods 23, preferably, there are four guiding rods 23 which are respectively arranged at four corners of the block 5. The block 5 is provided with a plurality of second through holes 53 slidably receiving the guiding rods 23 so that the block 5 is slidably mounted on the guiding rods 23. The first elastic part 52 is respectively mounted around the guiding rods 23, and two ends of each first elastic part 52 respectively abut the block 5 and the bottom wall of the receiving space 21. The block 5 is pushed to the front end of the pins 22 under the force of the first elastic part 52, in such a way that, human hands reaching into the other receiving space 21 would be blocked by the block 5 rather than directly touch with the pins 22, which prevents the accident of electric shock.

Preferably, the block 5 is provided with a through groove 54 for the sliding rod passing through, when the plug is plugged in one of the receiving space 21, the plug 1 urges one end of the sliding rod and pushes the sliding rod to move so that the other end of the sliding rod passes through the through groove 54 and protrudes into the other receiving space 21. Both ends of the sliding rod can slide and pass through the through groove 54, that is, the sliding rod is movably connected with the block 5. When the plug is plugged in one of the receiving space 21, the plug 1 touches the block 5 and one end of the sliding rod and urges both of them to slide simultaneously. Accordingly, the plug 1 and pins 22 are connected together, in the meanwhile, the other end of the sliding rod protrudes into the other receiving space 21 and thus blocks another plug 1 to plug in the other receiving space 21. The structure used is simple and avoids electric leakage caused by misoperation of plugging two plugs in both ends of the power strip 2.

Alternatively, both ends of the sliding rod are respectively fixedly connected with one said block 5, when the plug is plugged in one of the receiving space 21, the plug 1 urges the block 5 and pushes the block 5 to slide, the block 5 in turn urges one end of the sliding rod and pushes the sliding rod to slide, the other end of the sliding rod thus protrudes into the other receiving space 21 and abuts the block 5. The sliding rod and the block 5 are connected in this case, that is, the sliding rod does not contact the plug 1 directly. When the plug is plugged in one of the receiving space 21, the plug 1 urges the block 5 to slide and the block 5 pushes the sliding rod to slide, which makes the other end of the sliding rod to protrude into the other receiving space 21. When the plug 1 and pins 22 are connected together, the other end of the sliding rod abuts against the block 5 in the other receiving space 21 thus blocks the block 5 in the other receiving space 21 to prevent the block from sliding, thereby achieving the goal of closing the other receiving space 21.

Preferably, the power strip further includes a protective door structure which comprises a baffle plate 55 and a second elastic part 56. Two ends of the second elastic part 56 are respectively connected with the baffle plate 55 and the block 5, the second elastic part 56 is used for restoring the position of the baffle plate 55. The baffle plate 55 is provided with a wedge-shaped block 57 and insert holes 551, the block 5 is provided with a recessed hole 58 for the wedge-shaped block 57 passing through, the baffle plate 55 is movably connected with the block 5, thus enables the insert holes 551 to be aligned or misaligned with the first through holes 51 in the block 5. Preferably, an engaging groove 50 is defined at an inner side of the block adjacent to the baffle plate 55. A bump 550 is formed on the baffle block 5 and engages with the engaging groove, so that the block 5 and the baffle plate 55 are slidably connected. Preferably, a protrusion 5500 is formed on the bump 550, one end of the second elastic part 56 is fixed on the protrusion 5500, the other end of second elastic part 56 is fixed on the block 5. Particularly, when there is no plug 1 plugged in the power strip 2, the wedge-shaped block 57 on the baffle plate 55 passes through the recessed hole 58 in the block 5, and the insert holes 551 and the first through holes 51 are misaligned and not communicated, and the pins 22 is spaced from the first through holes 51 by the baffle plate 55. When the block 5 moves towards the pins 22 under an action of an external force, the pins 22 would be blocked by the baffle plate 55 and thus cannot pass through the first through holes 51 so that the risk of occurring the accident that hands touch the pins 22 can be avoided, significantly increasing the security of using the power strip. The device according to the present invention has the advantageous construction and high security for electricity. Only when the plug 1 matching with the power strip 2 is plugged in, the end face of the plug 1 touching the wedge-shaped block 57 and pushing the baffle plate 55 to move, until the insert holes 551 align and communicate with the first through holes 51, the pins 22 can pass through the first through holes 51 and the insert holes 551 successively, and then connect with the plug 1. When a plug 1 mismatching with the power strip 2 is tried to be plugged in, it will fail to make the plug 1 and the power strip 2 interconnected, so that security risk that fire striking of pins caused by mis-plugging or error-plugging plugs leading to damaging relevant electric appliances can be avoided.

Combining with the structures of mounting seat 4, baffle plate 55 and block 5, a series of problems such as oxidation caused by externally exposing pins 22 can also be avoided.

The first elastic part 52 and the second elastic part 56 are both springs. It would be understood that other materials with good elasticity are also suitable for the first elastic part 52 and the second elastic part 56.

Figure 11:
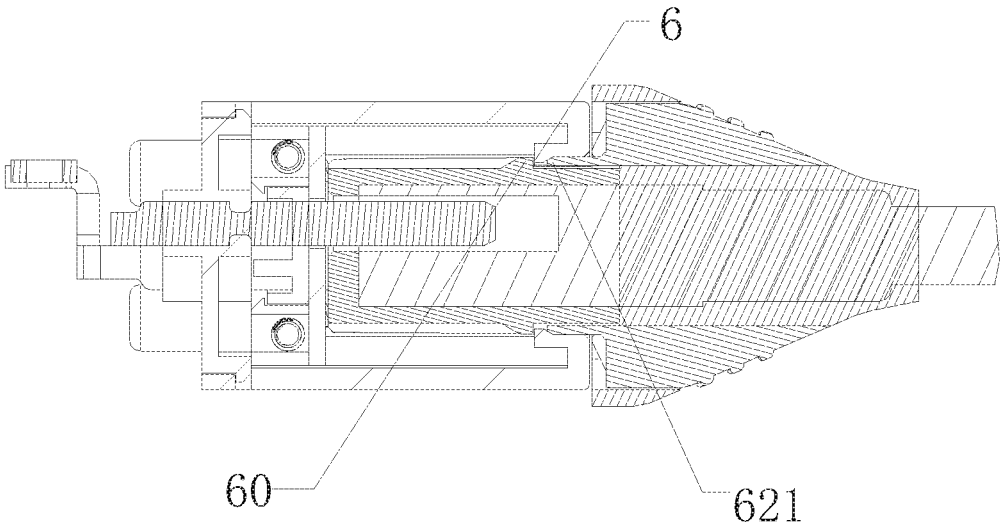
FIG. 11 is a partial cross sectional view of the power strip assembly with plug according to the present invention, in which the plug and the power strip is assembled together.
Figure 12:
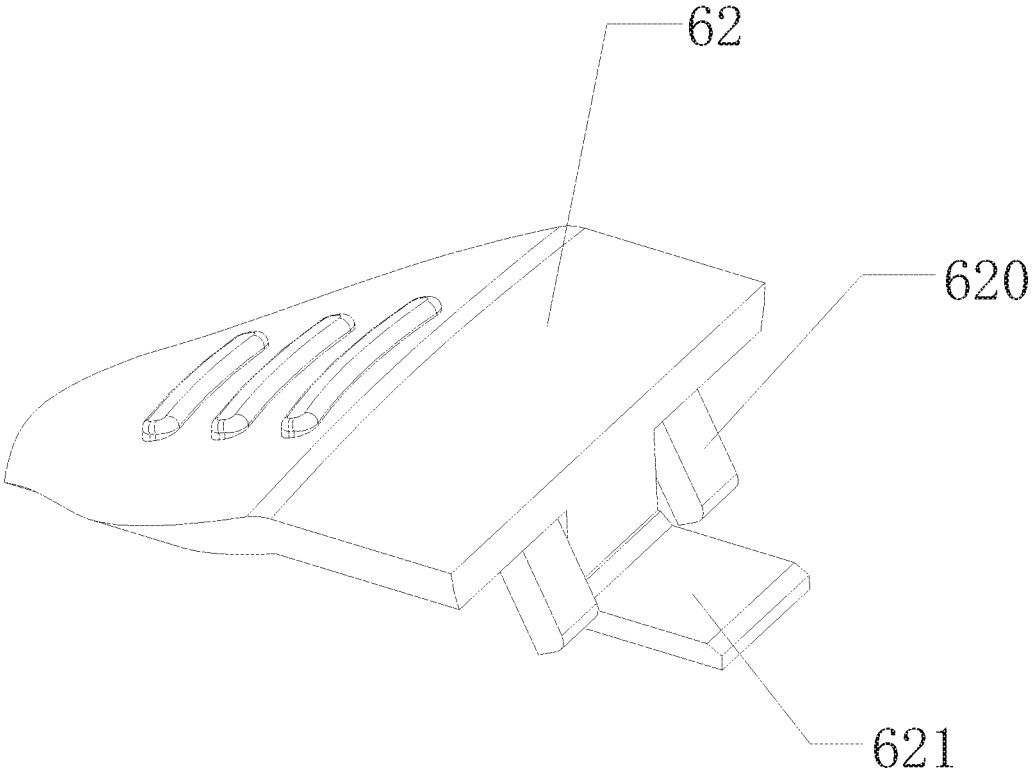
FIG. 12 is a schematic view of a push plate of the power strip of FIG. 11.

Preferably, as shown in FIGS. 11 and 12, a fastening structure is provided on the plug 1 and power strip 2 for fixedly connecting the plug 1 and power strip 2 when the plug 1 is plugged into the power strip 2. Preferably, the fastening structure comprises a buckling section 6 located on the power strip 2 and a joining section 60 located on the plug 1, one of the buckling section 6 and the joining section 60 is elastic, when the plug 1 is plugged into the power strip 2, the buckling section 6 and the joining section 60 are interlocked. In this embodiment, the buckling section 6 is elastic material and formed on the mounting seat 4. Preferably, the fastening structure also comprises a push plate 62 slidably connected with the plug 1, the push plate 62 is provided with an elastic piece 620 two ends of which are respectively abut against the push plate 62 and the mounting seat 4, and a tongue piece 621 for separating the buckling section 6 and the joining section 60. Preferably, one end of the elastic piece 620 is fixed on the push plate 62, while the other end of the elastic piece 620 faces towards the mounting seat 4 and slopes downwardly. Preferably, there are two elastic pieces 620. One end of the tongue piece 621 is fixed on the bottom of the push plate 62, while the other end of the tongue piece 621 extends towards the mounting seat 4. Due to the elastic piece 620, a certain distance is formed between the push plate 62 and the mounting seat 4, which enables the buckling section 6 to be clamped between the tongue piece 621 and the joining section 60, thus achieving interlocking of the buckling section 6 and the joining section 60, such that the plug 1 and the power strip 2 can be fixed after the plug 1 is plugged in the power strip 2. When the plug 1 is being pulled off, users only need to push the push plate 62 towards the mounting seat 4 until the tongue piece 621 moves to a position below the buckling section 6, the buckling section 6 would be pushed out and disengaged from the joining section 60, so that the plug 1 can be pulled off from the power strip 2. Preferably, the plug 1 is provided with one said push plate 62 and one said joining section 60 on both top and bottom sides, correspondingly, the mounting seat 4 is also provided with one said buckling section 6 on each of the interior top and bottom sides, which further improves the connection stability of the plug 1 and the power strip 2. Adopting the above mentioned structure of the plug 1 and the power strip 2 fixedly connected can avoid the risk that fire striking of pins caused by unstable connection which results in damaging plug 1 or electric appliances.

The above mentioned power strip assembly with plug can be applied to all electrical equipments, for example, major appliances such as washing machines, fridges or the like, and small home appliance such as heating kettle, electric cooker or the like.

The above descriptions are merely the best embodiments and not to limit the scope of the invention, thus equivalent variations for the claims of the invention also belong to the scope of protection of the invention.

What is claimed is:

1. A power strip with two ends safely pluggable, used for connecting with a plug, wherein the power strip is provided with two receiving spaces respectively arranged at two ends of the power strip for allowing the plug to plug in, the receiving space is provided with pins and a blocking structure, the blocking structure is configured for, when the plug is plugged into one of the receiving spaces, closing or obstructing the other receiving space; and wherein a block is slidably mounted in the receiving space, the block has first through holes to allow the pins to pass through, a first elastic part is provided between the block and a bottom wall of the receiving space and is used for exerting a force on the block away from the bottom wall of the receiving space when the first elastic part is pressed.

2. The power strip with two ends safely pluggable according to claim 1, wherein the blocking structure comprises a sliding part which is slidably mounted in the power strip, when the plug is plugged into one of the receiving spaces, one end of the sliding part away from the one of the receiving space protrudes into the other receiving space.

3. The power strip with two ends safely pluggable according to claim 2, wherein the sliding part is a sliding rod which linearly slides along a length of the power strip.

4. The power strip with two ends safely pluggable according to claim 2, wherein the block is provided with a through groove for the sliding part passing through.

5. The power strip with two ends safely pluggable according to claim 2, wherein both ends of the sliding part are respectively fixedly connected with the block.

6. The power strip with two ends safely pluggable according to claim 1, wherein the receiving space is provided with a plurality of guiding rods which are slidably connected with the block, the first elastic part is mounted around the guiding rod.

7. The power strip with two ends safely pluggable according to claim 1, wherein the power strip further includes a protective door structure which comprises a baffle plate and a second elastic part, two ends of the second elastic part are respectively connected with the baffle plate and the block, the baffle plate is provided with insert holes and is slidably connected with the block, thus enables the insert holes to be aligned or misaligned with the first through holes in the block.

8. The power strip with two ends safely pluggable according to claim 7, wherein the baffle plate is provided with a wedge-shaped block.

9. A power strip assembly with plug, comprises the power strip with two ends safely pluggable according to claim 1 and a plug pluggable with the power strip.

10. The power strip assembly with plug according to claim 9, wherein the blocking structure comprises a sliding part which is slidably mounted in the power strip, when the plug is plugged into one of the receiving spaces, one end of the sliding part away from the one of the receiving space protrudes into the other receiving space.

11. The power strip assembly with plug according to claim 10, wherein the sliding part is a sliding rod which linearly slides along a length of the power strip.

12. The power strip assembly with plug according to claim 10, wherein the block is provided with a through groove for the sliding part passing through.

13. The power strip assembly with plug according to claim 10, wherein both ends of the sliding part are respectively fixedly connected with the block.

14. The power strip assembly with plug according to claim 9, wherein the receiving space is provided with a plurality of guiding rods which are slidably connected with the block, the first elastic part is mounted around the guiding rod.

15. The power strip assembly with plug according to claim 9, wherein the power strip further includes a protective door structure which comprises a baffle plate and a second elastic part, two ends of the second elastic part are respectively connected with the baffle plate and the block, the baffle plate is provided with insert holes and is slidably connected with the block, thus enables the insert holes to be aligned or misaligned with the first through holes in the block.

16. The power strip assembly with plug according to claim 9, wherein a fastening structure is provided on the plug and the power strip for fixedly connecting the plug and the power strip when the plug is plugged into the power strip.

17. The power strip assembly with plug according to claim 16, wherein the fastening structure comprises a buckling section arranged on the power strip and a joining section arranged on the plug, one of the buckling section and the joining section is elastic, when the plug is plugged into the power strip, the buckling section and the joining section are interlocked.

18. The power strip assembly with plug according to claim 17, wherein the fastening structure further comprises a push plate slidably connected with the plug, the push plate is provided with an elastic piece two ends of which are respectively abut against the push plate and the power strip, and a tongue piece for separating the buckling section and the joining section.

* * * * *